United States Patent [19]

Wood

[11] Patent Number: 4,764,140

[45] Date of Patent: Aug. 16, 1988

[54] MEXICAN JUMPING BEAN TOY

[76] Inventor: Nelson Wood, 20 Dean Rd., Brookline, Mass. 02146

[21] Appl. No.: 935,008

[22] Filed: Nov. 26, 1986

[51] Int. Cl.[4] ..... A44C 9/00

[52] U.S. Cl. ..... 446/14; 446/26; 63/15; 63/2

[58] Field of Search ..... 63/15, 2; D11/33, 32, D11/77, 78; 446/14, 26, 392, 268; 272/8 R, 8 N

[56] References Cited

U.S. PATENT DOCUMENTS

| | | | |
|---|---|---|---|
| 1,421,329 | 6/1922 | Welch | 63/2 |
| 1,548,646 | 8/1925 | Akeson | 63/15 |
| 1,794,784 | 3/1931 | Marinelli | 63/15 |
| 2,134,586 | 10/1938 | Silver | 63/15 |
| 2,585,183 | 2/1952 | Stern | 63/15 |
| 2,619,772 | 12/1952 | Dikszas | 446/392 |
| 3,081,997 | 3/1963 | Glass | 63/15 |
| 3,951,133 | 4/1976 | Reese | 128/2 |
| 4,052,864 | 10/1977 | Hofsaess | 63/31 |
| 4,135,645 | 1/1979 | Kimmell | 222/83 |
| 4,187,697 | 2/1980 | Castelo | 63/31 |

*Primary Examiner*—Richard J. Johnson

*Attorney, Agent, or Firm*—Lorusso & Loud

[57] ABSTRACT

A Mexican jumping bean toy comprising a ring which incorporates a Mexican jumping bean. The ring is constructed so that even when the caterpillar inside the Mexican jumping bean is in a dormant stage, heat and/or light will reach the bean to reactivate the caterpillar. The ring may further be structured to allow movement of the container housing the bean as the bean tosses about.

8 Claims, 1 Drawing Sheet

MEXICAN JUMPING BEAN TOY

BACKGROUND OF THE INVENTION

The present invention relates to a Mexican jumping bean toy, and more particularly to a ring which incorporates the Mexican jumping bean and in which the movement of the Mexican jumping bean will provide hours of entertainment for children of all ages.

Mexican jumping bean is a common name for a seed of any of several Mexican shrubs of the Spurge family that tumbles about because of the movements of the larva of a small moth inside of it. The seed initially is a nursery for the moth caterpillar. A female moth lays an egg in the seed of the plant when the seed is forming and subsequently, the seed develops around the egg. Once hatched from the moth egg, the caterpillar begins at once to grow and eats all the fruit in the seed. At this stage, the movement of the bean is caused by the caterpillar feeding inside of it. Eventually, the seed coat is left and becomes a shell around the caterpillar.

The caterpillar then lines its shell with silk to form a coccoon for its transformation to a moth. As it spins the silk, it moves from side to side and makes the bean jump. For several months thereafter, the caterpillar lives inside the seed in the cocoon. During those months, the bean may stop jumping but the heat from a person's hand may make the insect move and thus make the bean jump again. Because of the unique nature of these beans, there are many games in which the jumping beans are incorporated.

It is therefore an object of the present invention to provide a toy which utilizes the unique nature of Mexican jumping beans to provide entertainment.

It is a further object of the present invention to provide a toy utilizing a Mexican jumping bean which can be worn as a ring.

It is another object of the present invention to provide a ring utilizing a Mexican jumping bean in which the movement of the bean will cause the container enclosing the bean to wiggle and turn.

SUMMARY OF THE INVENTION

A Mexican jumping bean toy is described herein, comprising a ring in several embodiments. In one embodiment, the ring comprises a band to which a container enclosing a Mexican jumping bean is attached. The container will have a hole cut in it in the area where the container touches the finger to allow for the transmission of heat from the finger to the Mexican jumping bean. The container is preferably made of a material which will transmit heat and/or light to the bean. The movement of the bean can be seen and felt through the container. The container can be shaped and decorated as desired, and a preferred embodiment comprises a container shaped like a sombrero. In a second embodiment, the ring comprises a transparent tumbler attached to the band with the Mexican jumping bean contained in the tumbler. As the Mexican jumping bean tosses about, the tumbler will turn with it.

DETAILED DESCRIPTION OF THE INVENTION

The present invention describes Mexican jumping bean toys, and more particularly rings which use and incorporate a Mexican jumping bean so that the movement of the Mexican jumping bean provides viewing and wearing entertainment.

Figure 1:
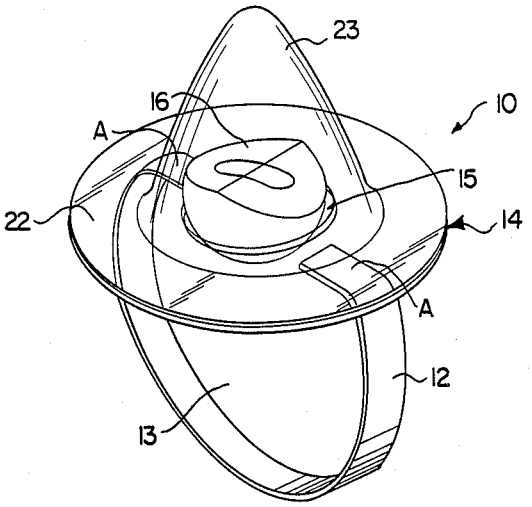
FIG. 1 illustrates one embodiment of the Mexican jumping bean ring of the present invention.

FIG. 1 illustrates one embodiment of the present invention. As shown in FIG. 1, a Mexican jumping bean ring 10 comprises a main finger engaging band 12, a container for a Mexican jumping bean 14 attached to the band, and a Mexican jumping bean 16 contained therein.

A main finger engaging band 12 is provided with an opening 13 therein for passage of a finger therethrough to encircle the finger and to contain the ring 10 on the finger. The band 12 is continuous to encircle the finger and ends where it is attached to the container for the Mexican jumping bean 14 at points A. The band 12 may be made of any material suitable for wear. For instance, the band may be made of an elastic, which is easy for a child to put on and remove from his finger. For a more finished look, the band may be made of a metal, such as silver or gold. The materials for the band can be chosen depending upon desired costs of producing the whole ring and the purposes for which the ring will be used, with the general purpose of providing an aesthetically pleasing appearance.

Affixed to the band 12 is a container 14 in which the Mexican jumping bean sits. The container is sized to be slightly larger than the Mexican jumping bean 16 which will be contained therein so that the bean 16 will have room to move as it jumps. The container 14 is formed from any material, but preferably will be a material which can transmit heat and/or light to the bean contained inside of it so that even when the caterpillar in the bean is in a dormant stage, the heat of the transmitted light or rays will cause the bean to begin jumping again. A suitable material is a transparent plastic. In addition, the container will have a hole 15 cut in the material in an area facing the band and the finger. In this manner, the heat of the person wearing the ring will flow from the person's finger to the Mexican jumping bean and cause the Mexican jumping bean to begin jumping again.

The container may have any shape. In the embodiment shown in FIG. 1, the container is shaped to resemble a sombrero, in keeping with the Mexican theme. It may atlternatively be a magician's hat or any hat. A hat as used in this invention will have a rim 22 and crown 23 and will be attached to the band 12 at points A on the rim 22. The hat may be decorated as desired but will preferably be decorated so that the ability of the material to transmit heat and/or light to the caterpillar in the jumping bean will not be affected. For example, the crown of the hat will be a transparent plastic and the rim can be opaque and brightly colored.

The band of the ring is attached to the rim of the hat at points A. The band may be fixedly attached, for example by an adhesive or, if a metal is used, by rivets. In a further embodiment, the container will be movably attached to allow the container to wiggle when the jumping bean moves due to stimulation by heat and/or light.

Figure 2:
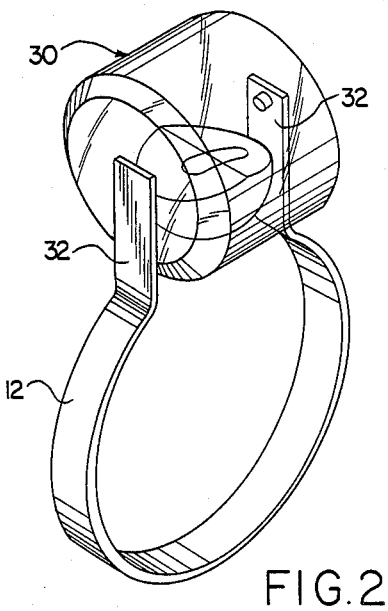
FIG. 2 illustrates a second embodiment of the Mexican jumping bean ring of the present invention.

A second embodiment is shown in FIG. 2. In this embodiment, instead of a hat attached to the band 12, a tumbler 30 stands on prongs 32 which are fixedly attached to the band 12. The tumbler 30 contains the Mexican jumping bean. The tumbler may comprise any material which can transmit heat and or light to the bean contained within it and will probably be a transparent plastic. The movement of a Mexican jumping bean will cause the tumbler 30 to turn and toss about.

The foregoing description should be taken as illustrative, and should not be considered to be limiting in any sense. Modifications and adaptations within the spirit of the invention will be evident to one skilled in the art.

What is claimed is:

1. A Mexican jumping bean ring comprising:

a main finger engaging band;

a container affixed to said main finger engaging band having an area cut out from the base of said container facing the finger of the wearer; and a Mexican jumping bean within said container.

2. The ring of claim 1 where said container comprises a hat comprising a rim and a crown.

3. The ring of claim 2 wherein said hat is a magician's hat.

4. The ring of claim 2 wherein said hat is a sombrero.

5. The ring of claim 2 wherein the crown of the hat is formed from a material which can transmit heat and/or light.

6. The ring of claim 5 wherein the material comprising the crown of said sombrero is transparent plastic and the rim of said sombrero is opaque and brightly colored.

7. The ring of claim 1 wherein said container is fixedly attached to said main finger engaging band.

8. A Mexican jumping bean ring comprising;

a main finger engaging band;

a tumbler mounted on said main finger engaging band formed of a material which can transmit heat and/or light;

means to movably mount said tumbler on said main finger engaging band; and a Mexican jumping bean within said movably mounted container.

* * * * *